US010734698B2

(12) United States Patent
Nielsen-Cole

(10) Patent No.: US 10,734,698 B2
(45) Date of Patent: Aug. 4, 2020

(54) DEPLOYABLE, CONFORMAL, REFLECTORS ANTENNAS

(71) Applicant: Orbital Composites Inc., San Jose, CA (US)

(72) Inventor: Cole Nielsen-Cole, San Jose, CA (US)

(73) Assignee: Orbital Composites Inc., San Jose, CA (US)

( * ) Notice: Subject to any disclaimer, the term of this patent is extended or adjusted under 35 U.S.C. 154(b) by 76 days.

(21) Appl. No.: 16/053,771

(22) Filed: Aug. 2, 2018

(65) Prior Publication Data

US 2019/0044213 A1 Feb. 7, 2019

Related U.S. Application Data

(60) Provisional application No. 62/540,562, filed on Aug. 2, 2017.

(51) Int. Cl.

| | |
|---|---|
| ***H01Q 1/08*** | (2006.01) |
| ***H01Q 19/06*** | (2006.01) |
| ***H01Q 3/44*** | (2006.01) |
| ***H01Q 15/23*** | (2006.01) |
| ***H01Q 15/16*** | (2006.01) |
| ***H01Q 3/46*** | (2006.01) |
| ***H01Q 25/00*** | (2006.01) |
| ***H01Q 3/26*** | (2006.01) |
| *H01Q 19/19* | (2006.01) |

(52) U.S. Cl.

CPC ..... *H01Q 1/081* (2013.01); *H01Q 3/2658* (2013.01); *H01Q 3/44* (2013.01); *H01Q 3/46* (2013.01); *H01Q 15/163* (2013.01); *H01Q 15/23* (2013.01); *H01Q 19/062* (2013.01); *H01Q 25/00* (2013.01); *H01Q 25/008* (2013.01); *H01Q 19/19* (2013.01)

(58) Field of Classification Search

CPC ..... H01Q 1/081; H01Q 19/06; H01Q 19/062; H01Q 19/065; H01Q 19/067; G02B 3/12

See application file for complete search history.

(56) References Cited

U.S. PATENT DOCUMENTS

2009/0302239 A1* 12/2009 Yonemoto ..... H01Q 15/08 250/503.1

2017/0279202 A1* 9/2017 Galla ..... H01Q 19/062

* cited by examiner

*Primary Examiner* — Daniel Munoz

(74) *Attorney, Agent, or Firm* — AdamantineIP

(57) ABSTRACT

A lens and antenna assembly technique that includes a first bladder that is configured to be filled with a first fluid and the first fluid having a first index of refraction. The technique further includes a second bladder nested within the first bladder. The second bladder is configured to be filled with a second fluid and the second fluid has a second index of refraction. This technique is for deploying an inflatable lens that includes inflating a first bladder with a first fluid and inflating a second bladder with a second fluid. The second bladder is nested within the first bladder. The technique for deploying an inflatable lens further includes replacing the first fluid with a third fluid and replacing the second fluid with a fourth fluid.

19 Claims, 9 Drawing Sheets

150

DEPLOYABLE, CONFORMAL, REFLECTORS ANTENNAS

CROSS-REFERENCE TO RELATED APPLICATIONS

The present application claims priority to Provisional Application No. 62/540,562, titled "Deployable, Conformal, Reflector Antenna," filed Aug. 2, 2017, which is hereby incorporated by reference in its entirety.

FIELD

The present disclosure generally relates to radio frequency (RF) antennas and, more specifically, to active and passive phased arrays.

BACKGROUND

Satellite antennas are usually designed with a dish shaped in the form of a parabolic reflector that reflects the signal to the dish's focal point. The dish is a directional waveguide that gathers the signals from a single direction and concentrates the radio signals at or near the focal point. Mounted on brackets at the dish's focal point is a transceiver that is designed to receive or transmit information by radio waves to or from a communication satellite. The size of the antenna for satellites cannot exceed the cargo space of the space craft. For small antenna dishes, available cargo space is not the determining factor and as such these can be rigid structures with a near-perfect curvature and a polished surface. Large antenna dishes that spread over an area larger than the cargo space can be unfurled with actuators that can be deployed into a parabolic-shaped dish in space. Deployable antenna dishes, however, pose challenges in that each conductive reflector is to be unfurled without creases or tears, which can cause imperfections in the curvature. The challenge is to provide a technique for deploying large antennas.

SUMMARY

The following presents a simplified summary of one or more examples in order to provide a basic understanding of such examples. This summary is not an extensive overview of all contemplated examples and is intended to neither identify key or critical elements of all examples nor delineate the scope of any or all examples. Its purpose is to present some concepts of one or more examples in a simplified form as a prelude to the more detailed description that is presented below.

In accordance with some examples, a lens, comprising: a first bladder, wherein the first bladder is configured to be filled with a first fluid, the first fluid having a first index of refraction; and a second bladder nested within the first bladder, wherein the second bladder is configured to be filled with a second fluid, the second fluid having a second index of refraction.

In accordance with some examples, an antenna assembly, comprising: a mounting fixture; a lens, the lens further includes: a first bladder connected to the mounting fixture, wherein the first bladder is configured to be filled with a first fluid, the first fluid having a first index of refraction; and a second bladder connected to the mounting fixture and nested within the first bladder, wherein the second bladder is configured to be filled with a second fluid, the second fluid having a second index of refraction; and a first transmitter operatively coupled to the mounting fixture, wherein the first transmitter is configured to transmit a first electromagnetic signal through the lens.

In accordance with some examples, a method for deploying an inflatable lens, the method comprising: inflating a first bladder with a first fluid; inflating a second bladder with a second fluid, wherein the second bladder is nested within the first bladder; replacing the first fluid with a third fluid; and replacing the second fluid with a fourth fluid.

In accordance with some examples, a dielectric lens, comprising: a reference surface; and a pattern of varying thicknesses made from a first dielectric, wherein the pattern of varying thicknesses is situated on the reference surface, and wherein thickness differences between adjacent formations of the pattern of varying thicknesses is less than an incident wavelength of electromagnetic energy.

In accordance with some examples, an antenna assembly, comprising: a mounting fixture; a lens connected to the mounting fixture, the lens further includes: a reference surface; and a pattern of varying thicknesses made from a first dielectric, wherein the pattern of varying thicknesses is situated on the reference surface, and wherein thickness differences between adjacent formations of the pattern of varying thicknesses is less than an incident wavelength of electromagnetic energy; and a transceiver operatively coupled to the mounting fixture, wherein the transceiver is configured to transmit an electromagnetic signal directed to the lens.

In accordance with some examples, a method for manufacturing a dielectric lens using a 3D printer, the method comprising: printing, using the 3D printer, a reference surface; and printing, using the 3D printer, a pattern of varying thicknesses made from a first dielectric on the reference surface, wherein thickness differences between adjacent formations of the pattern of varying thicknesses corresponds to a resolution of the 3D printer and are less than an incident wavelength of electromagnetic energy.

BRIEF DESCRIPTION OF THE FIGURES

For a better understanding of the various described examples, reference should be made to the description below, in conjunction with the following figures in which like-referenced numerals refer to corresponding parts throughout the figures.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well-known structures and components are shown in block diagram form in order to avoid obscuring such concepts.

Examples of antennas will now be presented with reference to various elements of apparatus and methods. These apparatus and methods will be described in the following detailed description and illustrated in the accompanying drawing by various blocks, components, circuits, steps, processes, algorithms, etc. (collectively referred to as "elements"). These elements may be implemented using electronic hardware, computer software, or any combination thereof. Whether such elements are implemented as hardware or software depends upon the particular application and design constraints imposed on the overall antenna.

Accordingly, in one or more examples, a deployable lens for the antenna is additively manufactured similar to inflating a series of bladders, one inside the other. Once deployed, the deployable lens can focus more than one transmitters and receivers (or transceivers), which reduces the number of multiple dishes for weight savings and reduced complexity. As such, one or more data signal may be transmitted simultaneously through the deployable lens and multiple feeds can be used concurrently and independently in any direction. Visually, the satellite receiver is a large sphere (e.g., ball) attached to the satellite that inflates (e.g., like a balloon) instead of unfolding dishes (e.g., like a flower).

Figure 1:
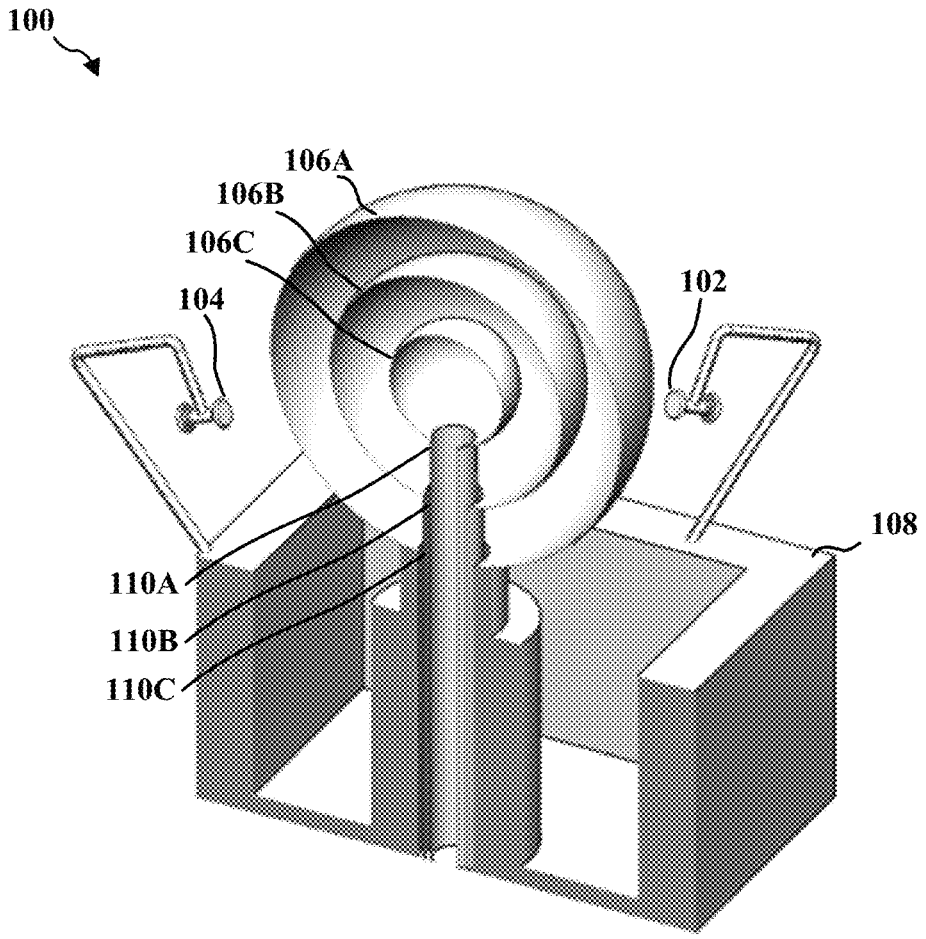
FIG. 1 illustrates examples of deploying a collapsed lens.

FIG. 1 illustrates a cross section diagram of a deployable lens 100. As depicted, deployable lens 100 includes a transmitter 102 and a receiver 104. The deployable lens further includes a first fluid injector 110A hermetically connected to the first bladder 106A and a first reservoir of a first fluid. The deployable lens further includes a second fluid injector 110B hermetically connected to the second bladder 106B and a second reservoir of the second fluid. The deployable lens further includes a third fluid injector 110C hermetically connected to the third bladder 106C and a third reservoir of the third fluid.

One or more data signal may be received transmitted through the deployable lens 100 and multiple transmitters and/or receivers feeds can be used simultaneously and working independently in any direction. Although only a cross-section is depicted the deployable spherical lens 100 can be visualized as a large balloon (e.g., sphere or ball) attached to a satellite that inflates instead of unfolding dishes (e.g., like a flower).

In particular, the technique inflates one or more bladders (106A, 106B, 106C), one inside of each other, concentrically to form the nested structure as depicted in FIG. 1 (e.g., nested third bladder 106C inside a second bladder 106B, inside first bladder 106A, etc.). It is contemplated that after a satellite leaves the rocket's launch shroud, the collapsed deployable lens 100 begins to deploy. In some examples, the largest/outermost bladder inflates first (e.g., first bladder 106A), followed by the next smaller one (e.g., second bladder 106B), the next smaller one (e.g., third bladder 106C), and so on.

In some examples, deployment take several seconds and can be deployed on satellite that is in space. In some examples, the mounting fixture 108 of the satellite is a box. In some examples, a satellite can deploy more than one deployable lens 100. In some examples, the deployable lens 100 is transparent over the range of electromagnetic energy directed to the lens. In some examples, the diameter of the fully deployed deployable lens 100 is larger than the satellite (e.g. twice as big). In some examples, the diameter of the fully deployed spherical lens is larger than solar panel arrays.

As described supra the satellite sequentially deploys (e.g., inflates) each bladder (106A, 106B, 106C) from the outermost bladder (e.g., first bladder 106A) to the innermost bladder (e.g., third bladder 106C) using a fluid such as a gas or liquid. Once the bladders have been inflated the fluid in the innermost bladder (e.g., third bladder 106C) is replaced with a first fluid having a first index of refraction. After the fluid in the innermost bladder (e.g., third bladder 106C) is filled with the first fluid, the fluid in the next nested bladder (e.g., second bladder 106B) is replaced with a second fluid having a second index of refraction. In some examples, the second fluid is different from the first fluid and has a different index of refraction.

This procedure continues until the fluid in outermost bladder (e.g., first bladder 106A) is replaced with a subsequent fluid (e.g., third fluid) with a third index of refraction. In some examples, the third fluid is different from the first fluid and the second fluid such that each has a different index of refraction, respectively. In such examples, the nested fluids can have index of refractions that decreases radially outward or radially inward. In some examples, any one of the replacement fluids (e.g., first fluid, second fluid, and the third fluid) is a gas. In some examples, any one of the replacement fluids (e.g., first fluid, second fluid, and the third fluid) is a liquid. In some examples, any one of the replacement fluids (e.g., first fluid, second fluid, and the third fluid) is a curing liquid that solidifies. It should be appreciated that in some examples, each bladder can be deployed (e.g., inflated) directly from a liquid.

In some examples, the nested fluids form a gradient-index lens. For example, a spherical reference surface of the deployable lens 100 is the focal point for parallel radiation incident on the opposite side. In some examples, the dielectric constant $\in_r$ of the material composing the deployable lens 100 falls from 2 at its center to 1 at its surface, In some examples, the refractive index, n, falls from $\sqrt{2}$ to 1, according to $$n = \sqrt{\in_r} = \sqrt{2 - \left(\frac{r}{R}\right)^2} \tag{1}$$

where R is the radius of the lens. Because the refractive index at the surface is the same as that of the surrounding medium, no reflection occurs at the surface. As such, the paths of the rays within the lens are arcs of ellipses.

In general, the bandwidth of the transmitter 102 and/or receiver 104 of the satellite is proportional to the size of the antenna dish reflector. The size of the antenna dish reflector is confined to the cargo space (e.g., launch shroud) of the space vehicle. As such, the design of antenna dish reflectors are either smaller rigid reflectors that fit in the confined space or larger reflectors that are actuator based and can be unfurled in a deployable manner.

Figure 2:
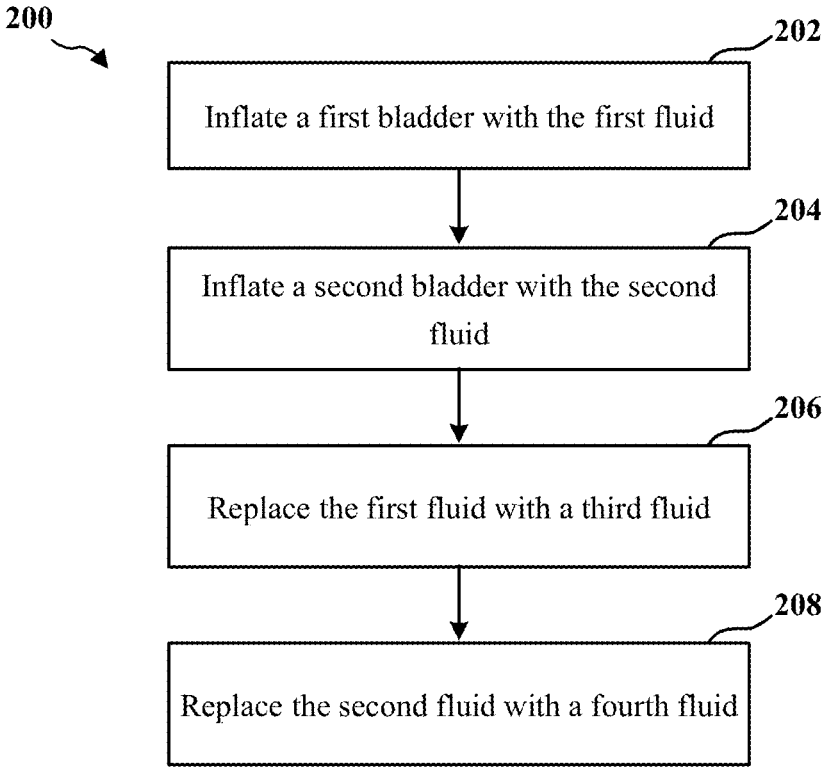
FIG. 2 is an exemplary flow diagram for printing phase arrayed lens.

FIG. 2 is an exemplary flow diagram for printing phase arrayed lens. Process 200 can be performed by a computer for deploying a lens of a satellite.

At operation 202, process 200 inflates a first bladder with a first fluid. The first fluid having a first index of refraction.

In some examples, at least a portion of the first bladder, when filled with the first fluid, has a spherical shape.

At operation 204, process 200 inflates a second bladder with a second fluid. The second bladder is nested within the first bladder. The second fluid having a second index of refraction. In some examples, at least a portion of the second bladder, when filled with the second fluid, has a spherical shape. In some examples, the second bladder, when filled with the second fluid, is spherically symmetric with the first bladder when filled with the first fluid.

At operation 206, process 200 replaces the first fluid with a third fluid having a first index of refraction.

At operation 208, process 200 replaces the second fluid with a fourth fluid having a second index of refraction. In some examples, the second index of refraction is greater than the first index of refraction. In some examples, any one of the first fluid, the second fluid, the third fluid, the fourth fluid is a liquid. In some examples, one or both of the third fluid and the fourth fluid is configured to solidify. In some examples, any one of the first fluid, the second fluid, the third fluid, the fourth fluid is the same.

For higher bandwidth applications, deployable antenna dish reflectors are often implemented. Deployable antenna dish reflectors can be unfurled antennae designs, such as articulated umbrellas, that allow for larger antenna to be packaged into the cargo space (e.g., launch shroud). In these unfurled antenna designs, the radius increases and the number of hinges in the umbrella increases nonlinearly. As such, the cost over radius increases exponentially (e.g., a second or third order cost increase). The deployment risk of malfunction likewise correlates with the number of hinges. That is, the larger umbrella antenna, the more the radius increases, the more moving parts, and the higher risk of malfunction. For example, during the lifetime of a satellite, a non-redundant component of the deployable antenna dish reflectors may fail thereby diminishing the communication ability of the antenna and potentially crippling the satellite. In some configurations, the reflector is non-continuous. In some configurations, the reflector includes one or more reflector tiles configured to direct light to a focal point. In some instances, hinges are provided between adjacent reflector tiles.

It should be appreciated that deployable antenna dish reflectors are often difficult to properly retract (e.g., fold). In particular, a crease or tear can significantly attenuate communication signals. As such, anti-crease designs that deploy and retract (after the forcefulness of launch and ejection) are expensive and subject to malfunction. Often, the three-dimensional (3D) surface of deployable reflectors cannot easily be folded or rolled along one dimension at a time. It should be appreciated that the examples provided herein fold to cylinders conducive to the cargo space.

Usually rigid and deployable reflector antenna dish reflectors conform to spherical or parabolic shapes, which can be costly and complex to manufacture. However, antenna dish reflectors can be manufactured using a flat-planar or arbitrarily conformal shape, regardless of the focal length or aperture radius. For example, phased array lens and reflectors can be manufactured using a flat geometry rather than a parabolic geometry. The phased array lens and reflectors, electronically implements time synchronization of incoming or exiting electromagnetic wavelets that directs the propagation or reception of the transmitted signal.

Figure 3:
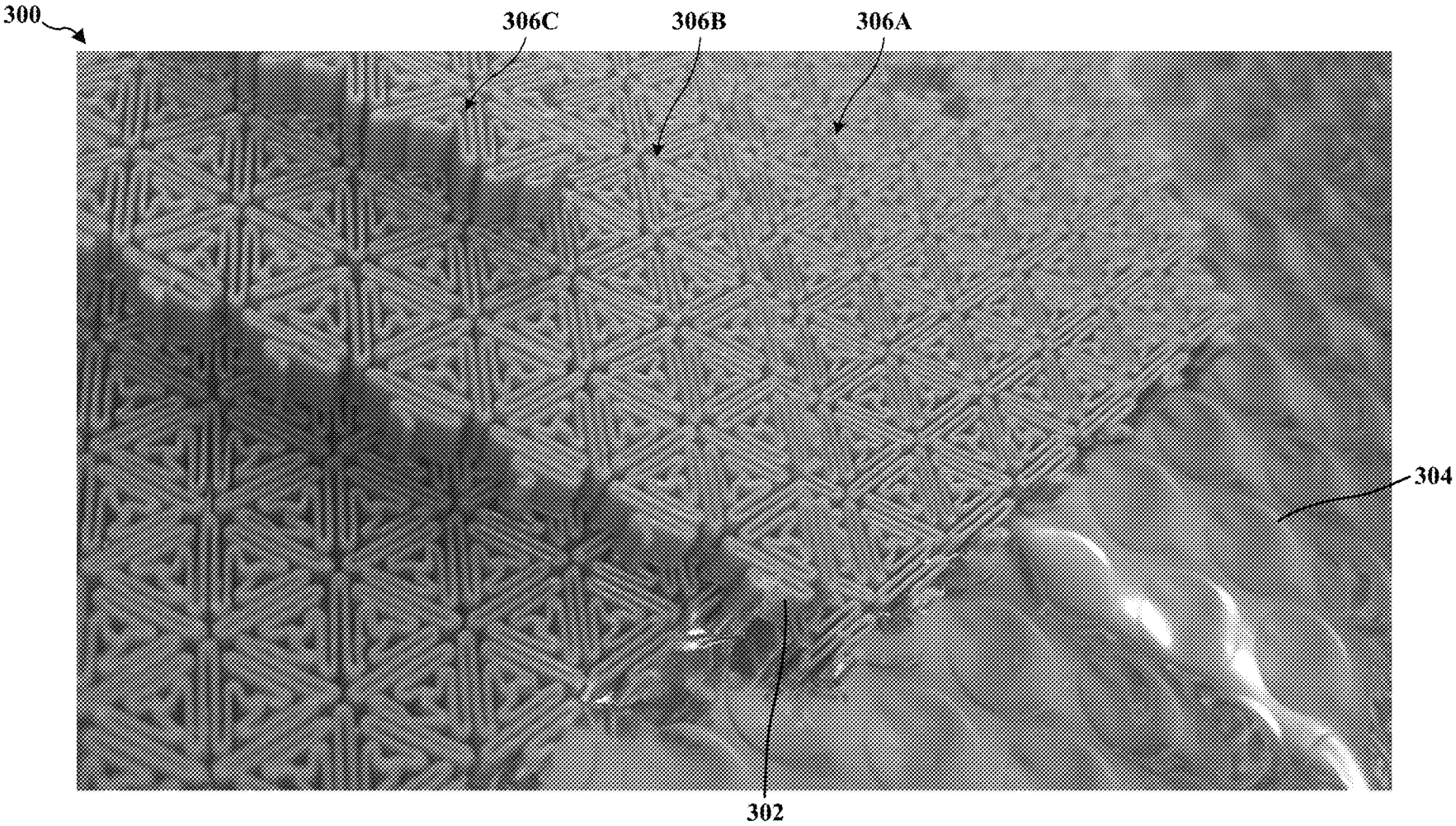
FIG. 3 illustrates an example of a gold plated phase arrayed reflector.

FIG. 3 illustrates an example of a gold plated phase arrayed reflector 300. As depicted in FIG. 3, the phase arrayed reflector 300 is made from a thermoplastic that is formed using additive manufacturing techniques. The thermoplastic includes a chiral Eigen mode lattice 302 with four thicknesses shown, specifically, a vacant ring 304 at the periphery and three ascending rings (306A, 306, B, 306C) approaching the center. The outermost ring (e.g., vacant ring 304) has a phase lag of zero and is essentially a bare reflector. The inner most ring (ring 306C) has a phase lag of 270°. In some examples, the phase arrayed reflector 300 is substantially flat and polished. The tri-axial directions of the chiral lattice cells have a negative Poisson ratio. As depicted in FIG. 3, each of the lattice cells are synclastic, whereas the phase arrayed reflector 300 is anti-synclastic.

In some examples, the phased arrays, provide for a ground plane that is fixed (e.g., global) or provided at an offset. In some examples, the phased arrays lens and reflectors, provide for a reference surface (e.g., ground plane) at an offset. For such an reference surface offsets the phased array is passively phase matched. For example, the reference surface offset can be arbitrarily shaped, which can leads to lower computational cycles and a higher throughput. In some instances, the reference surface offset provides for a variation of the local dielectric strength and thickness. In some examples, additive manufacturing techniques can manufacture phased arrays. It should be recognized that the cost for additive manufacturing techniques is intended to be inexpensive when compared to other method of current space craft reflector fabrication.

In some examples, phased array lens or reflectors are a form of conformal optics. Phased array lens or reflector exchange dielectric strength and thickness across quasi-periodic radial distributions in order affect image intensification. As such, additive manufacturing techniques can manufacture dielectric lenses with a cost effective variation of these parameters.

Passive, conductive, stepped reflectors are a subset of phased array lens or reflector optics. That is, if the steps are much smaller than the incident wavelength, the passive, conductive, stepped reflectors can form a coherent image. In such instances, the additive manufacturing techniques fragment the conductors at the smaller sizes to form the reflector with the desired resolutions.

In some examples, optimally passive, conformal dielectric lenses can be additively manufactured onto conductive, planar ground plane sheets. In such instances, electronically activated, conductive elements can be formed into the dielectric structures, or printed onto the outer surfaces.

In some examples, coaxial extrusion can be implemented to deposit a heterogeneous composite structure onto a continuous planar open face mold. In such instances, the dielectric materials used include thermoplastic (e.g., PEEK), Fiberglass, and additives such as $TiO_2$. In such instances, the conductive materials can include Au plated carbon fiber, metal wires, and/or additives such as graphene.

In some examples, the planar structure includes an electrically conductive ground plane, a dielectric lens, electrical interconnects (e.g., wiring), and other optional electronic elements. In some examples, discrete electronics such as integrated circuits (ICs) are embedded into the 3D structure.

In some examples, the design uses multifunctional composites. For example, the ground plane can be both the primary load bearing structure and the electrically conductive reference plane. In some instances, the ground plane is a composite made of gold plated carbon fiber and thermoplastic (e.g., PEEK). In some instances, the thermoplastic composite ground plane has a coefficient of thermal expansion substantially equal to zero. In some instances, the ground plane is perforated or additively manufactured in a sparse, mesh-like manner. The perforations of the ground plane provides for the acoustic loadings of the launch to pass through the structure without substantially loading the ground plane.

In general, the planar ground plane is a two dimensional (2D) surface or nearly 2D surface, which provides for the deployable antenna dish reflector to be folded along a single continuous axis. In some examples, the planar reflector structure of the antenna dish reflector can be rolled into a tube. For the most part, one-dimensional (1D) tube rolling is non-realizable with conventional 3D circular or parabolic dish reflectors as the cylindrical structure of a hollow tube facilitates wrapping the flexible reflector around the satellite's main body. Thin film solar panels, while less efficient than rigid glass, may be tightly folded and deploy more reliably. Thin film solar panels may also be wrapped around the satellite. By completing multiple perimeters within the launch shroud, large apertures may be efficiently packed with a minimum bulk, while not requiring complicated folding mechanisms.

In some examples, the dielectric lens in this design is additively manufactured on to the surface of the ground plane. The lens has a circular or elliptical rings of varying heights and densities that are used to focus an incident plane wave onto a focal point transceiver. The dielectric lens can be made from fiber glass and/or thermal plastic (e.g., PEEK). The dielectric lens is configured to avoid acoustic loading and can be perforated. In some instances, the perforations are a small percentage of the total frontal surface area. In some instances, the perforations cover a substantial percentage of the surface area exposing the majority of the ground plane surface.

In some configurations, the lens is a ground plane covered in quantum dots. In some examples, the dots are continuous on the surface. In some examples, the quantum dots are separated (e.g., mechanically separated), which provides for a zero coefficient of thermal expansion to control the global shape of the reflector dish.

Figure 4A:
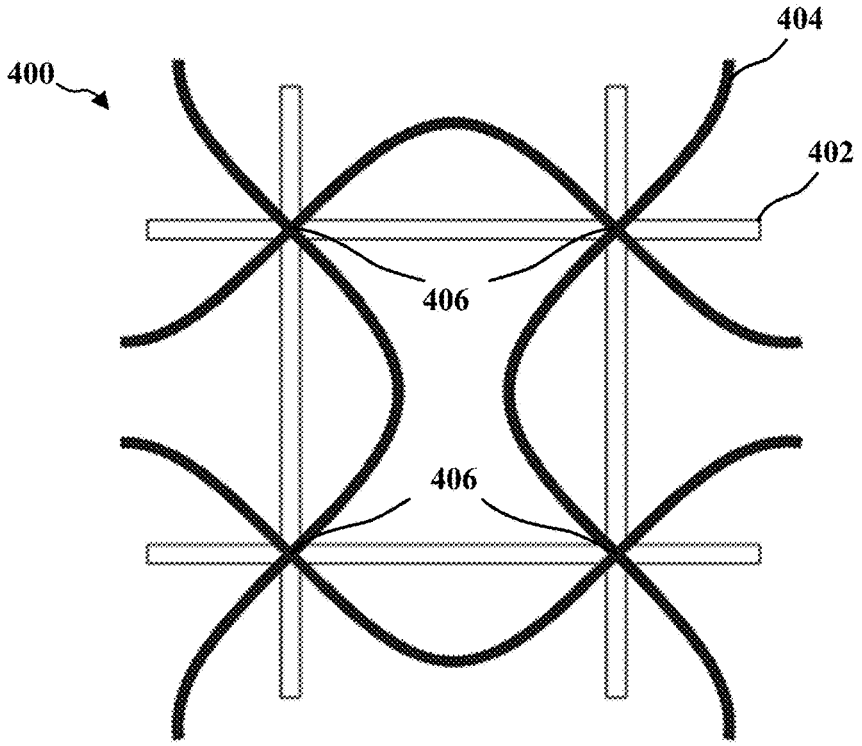
FIGS. 4A and 4B illustrate an example of chiral Eigen mode lattices.
Figure 4B:
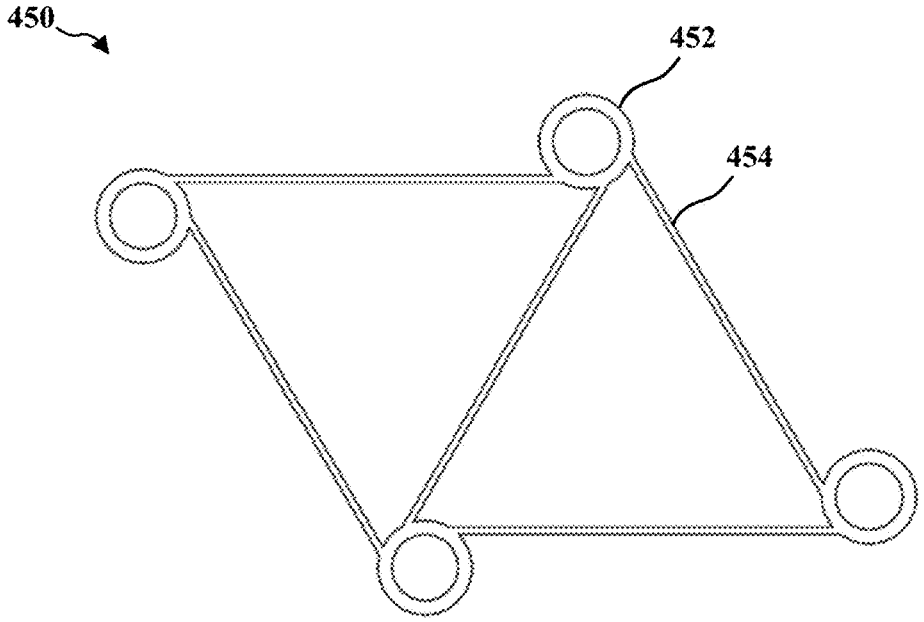

FIGS. 4A and 4B illustrates an example of chiral Eigen mode lattices 400. As depicted in FIG. 4A, peak and valley chiral of the Eigen mode lattice structure is rectilinear grid. The initial state of the chiral Eigen mode lattice 400 has no strain or deformation and as such is a straight rectilinear grid 402. The activated state is strained and has deformation and as such is a curved rectilinear grid 404. As depicted the spatial displacement of the lattice centers 406 of the activated state does not shift from the initial state. That is, while the lattice centers 406 of the spans displace and are strained, the nodes (also located at lattice centers 406) in the bi-axial mesh do not translate as displacement increases. This non-displacement at the lattice centers 406 represents a chiral internal rotation without nodal displacement is the Eigen function of the chiral Eigen mode lattices 400.

FIG. 4B depicts another chiral Eigen mode lattice 450 that is tri-axial and anisotropic. The tri-axial Eigen mode lattice 450 has a hub 452 and one or more spokes 454 that connect to adjacent hubs 452. In this example, the hubs 452 and portions of one or more spokes 454 have a higher coefficient of thermal expansion, while certain regions of the one or more spokes 454 have a relatively low coefficient of thermal expansion. Realization of this structure is accomplished through a variance in the printed material's coefficient of thermal expansion with the addition of discontinuous fibers such as fiberglass or carbon fibers. The exclusion of such additives increases the localized coefficient of thermal expansion and an inclusion of additives decreases the localized coefficient of thermal expansion. That is, one or more spokes 454 (e.g., node-to-node line segments) act as opposed bi-metallic strips of unequal coefficient of thermal expansion. As such, each hub 452 rotates with changes in temperature thereby keeping the hub distance (e.g., node-to-node distance) constant. Alternatively, in some configurations, hubs 452 and portions of one or more spokes 454 are made from a stiffer material compared to certain regions of the one or more spokes 454. In such configurations, the variation of stiffness results in a variation of localized natural resonant frequencies and damping coefficient. In some instances, the masses of the hubs 454 in the tri-axial Eigen mode lattice 450 can be varied to modify the local resonant mechanical frequencies and damping coefficient. In such instances, the radius of the hubs 452 and the spoke 454 lengths, differentially change the coefficient of thermal expansion, resonant mechanical frequencies, and damping coefficient.

In some instances, isochiral lattices may be formed by considering mass distribution, stiffness distribution, and density distribution, and the like. In such, instances, the isochiral lattices are configured to have resonant acoustic frequencies that dampen out launch vibrations and acoustics. It should be appreciated that the chiral nature of the lattice elements provides for strains created by the nonzero coefficient of thermal expansion to be internally dissipated, without changing the shape of the overall dish. As such, the thermal strain will be dissipated within each lattice cell of the dielectric lens.

Figure 5A:
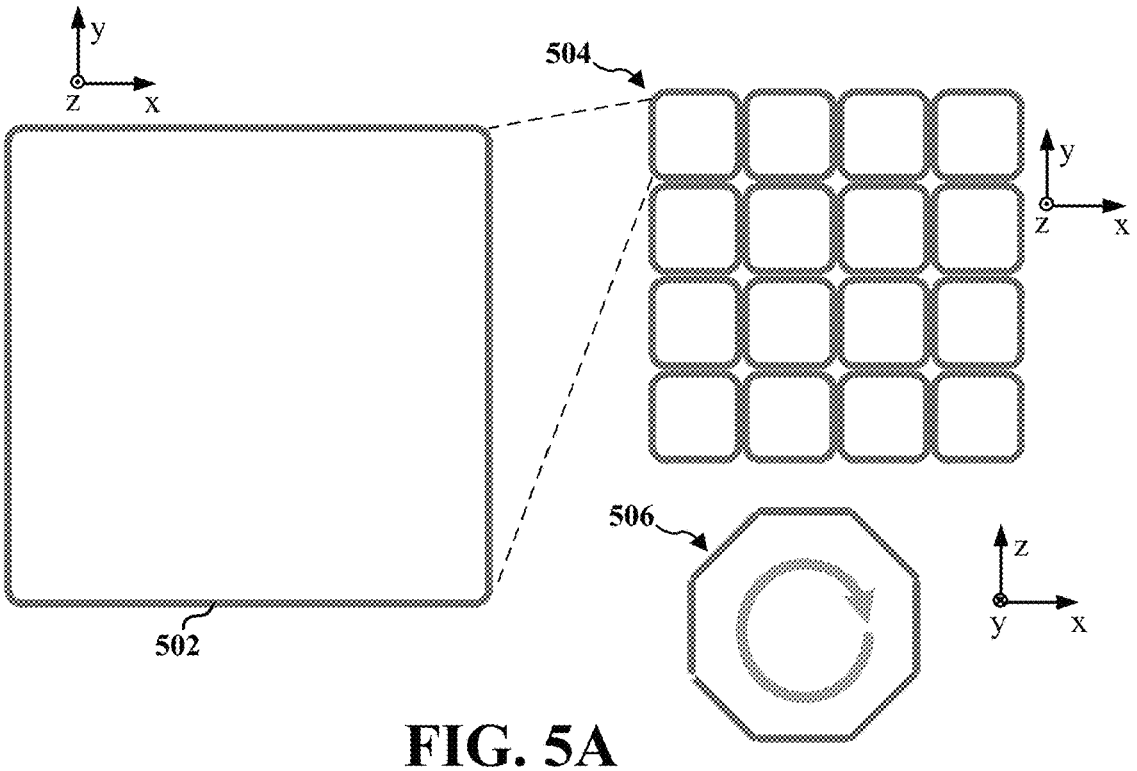
FIGS. 5A-5C illustrate various chiral structures for thermal compensation.
Figure 5B:
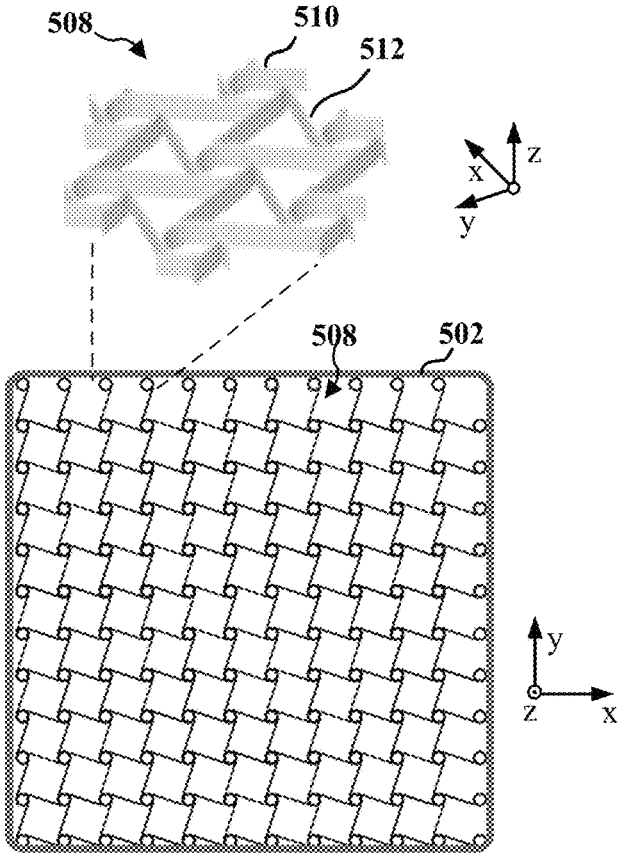
Figure 5C:
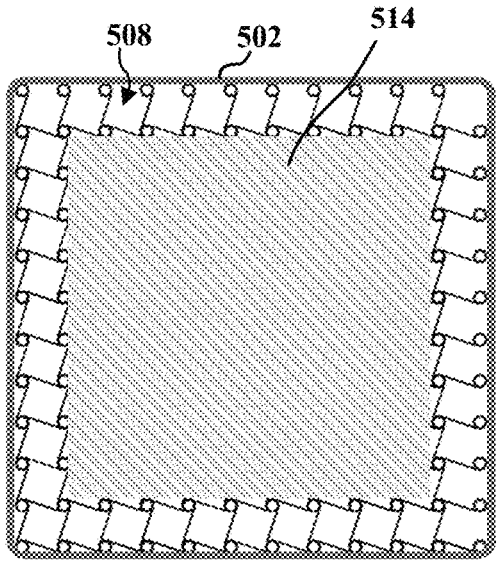

FIGS. 5A-5C illustrate various chiral structures for thermal compensation. The hoop structure 502 depicted in FIG. 5A becomes the backbone of the system. In particular, the hoops can be interconnected with adjacent hoops to form various structures. For example, adjacent hoops can be interconnected with adjacent hoops to form a flat array 504 of hoops depicted in FIG. 5A. Likewise, adjacent hoops can be interconnected with adjacent hoops to form a column array 506. In some examples, adjacent hoops are connected using hinges, which provides for freedom of motion during deployment. For example, adjacent hoops can be interconnected with hinges that provides for an array of adjacent hoops to morph from a column array 506 to a flat array 504. In some examples, the hoops are made from any one of carbon fiber, fiberglass, thermoplastic, or any combination thereof.

FIG. 5B depicts the hoop structure 502 with a chiral lattice array 508. In some examples, the chiral lattice array 508 is printed using additive manufacturing and is printed in thermoplastic (e.g., Ultem). As depicted in FIG. 5B, the chiral lattice array 508 may include hubs 510 and spokes 512 and is configured with a negative Poison ratio. As such, when heated, the chiral lattice array 508 expansion of each hoop 502 rotationally translate. That is, the lattice hubs remain in the same location relative to the hoop 502, and the strain of the thermal expansion is deferred to a twist in each hub 510. It should be appreciated that the configuration depicted in FIG. 5B effectively dampens vibrations. In such instances, the masses of each hub 510 can be tuned for specific resonant frequencies.

FIG. 5C depicts reflective surface adjacent to the hoop structure 502 of a chiral lattice array 508 with a reflective sheet 514 to form a ground plain. The reflective sheet 514 can be made of graphene or other conductive materials (e.g., gold, silver, copper, etc.) In some examples, the reflective sheet 514 is made using additive manufacturing. In some examples, the reflective sheet 514 is made using carbon fiber processing. In some configurations the reflective sheet 514 is rigid. In some examples, the flat array 504 that supports the reflective sheet 514 is configured to change the pointing angle. In some examples, the flat array 504 that include a plurality of reflective sheets 514. Some configurations include actuators configured to move one or more reflective sheets 514. In such configurations, one or more reflective sheets 514 are directed to provide active phase matching.

In some examples, the global effect of the chiral dots in combination with the planar reflector is to provide the whole reflector with a planar shape memory. That is, as the large aperture reflector is rolled into the launch configuration, it gains an internal strain. The release of the binding mechanism initiates the dish to unroll itself and return to its planar shape memory. In some examples, the reliability rate of deployment is increased by including flexing bladders on the antenna dish reflector. In some instances, the bladders are inflatable and may have UV curing epoxies configured to lock the bladders into final position without any hinges or traditional mechanics.

In some configurations, inflatable bladders are configured unroll the dish after ejection from the launch shroud. In some examples, the inflatable bladders are configured to be filled with fluid such as gasses or liquids. In some instances, the injected substances undergoes physical changes or chemical reactions. For example, a foam can be injected in the bladder that is configured to expand and UV-catalyze (e.g., solidify). In some configurations, the injected substances is a dielectric with a dielectric constant. In some examples, the bladders are shaped so as to form a dielectric lens on the surface of the reflector.

Figure 6A:
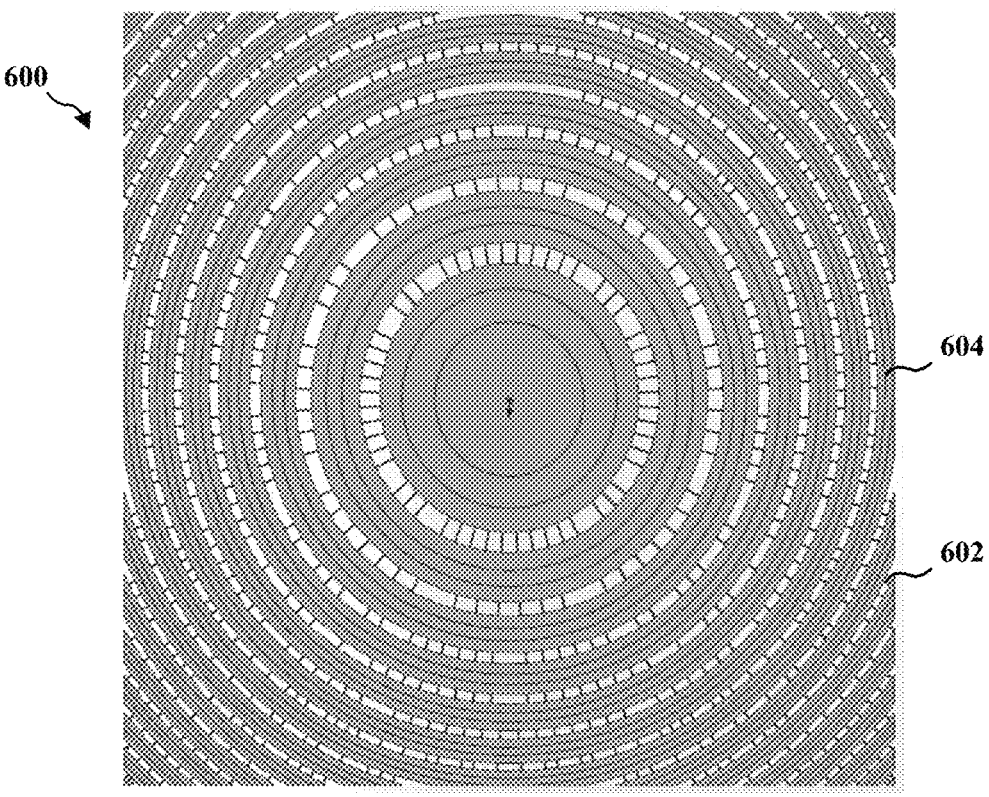
FIGS. 6A and 6B illustrates a frontal view and an ISO view of a phase arrayed lens.

The phase arrayed lens/reflector 600 depicted in FIG. 6A includes a series of stepped rings that includes one or more ascending rings 604 and adjacent to one or more vacant rings 602. The stepped rings configuration directs incident light to a focal point. The phased array/reflector 600 can be made from transparent thermoplastics of composite material with a dielectric constant and a loss tangent. In some examples, the dielectric loss tangent directly affects the insertion loss of the lens/reflector system. In some configurations, the loss tangent of thermoplastic and composite materials is controlled by variation of its density. In some configurations, there is a nearly linear correlation between lattice density variation and loss tangent. In some configurations, there is a substantially linear correlation between lattice density variation and dielectric strength. In some configurations, low loss, high dielectric strength additives are added to the thermoplastic matrix. For example, $TiO_2$ can be added to the thermoplastic (e.g., PEEK), which increases the dielectric strength of the plastic while decreasing the thickness of the lens. In some configurations, the loss tangent of the plastic lens decreases with low-loss additives. In some configurations, the insertion loss will decrease as the lens gets thinner, increasing RF subsystem efficiency. The thinner lenses reduces thermal strain.

Figure 6B:
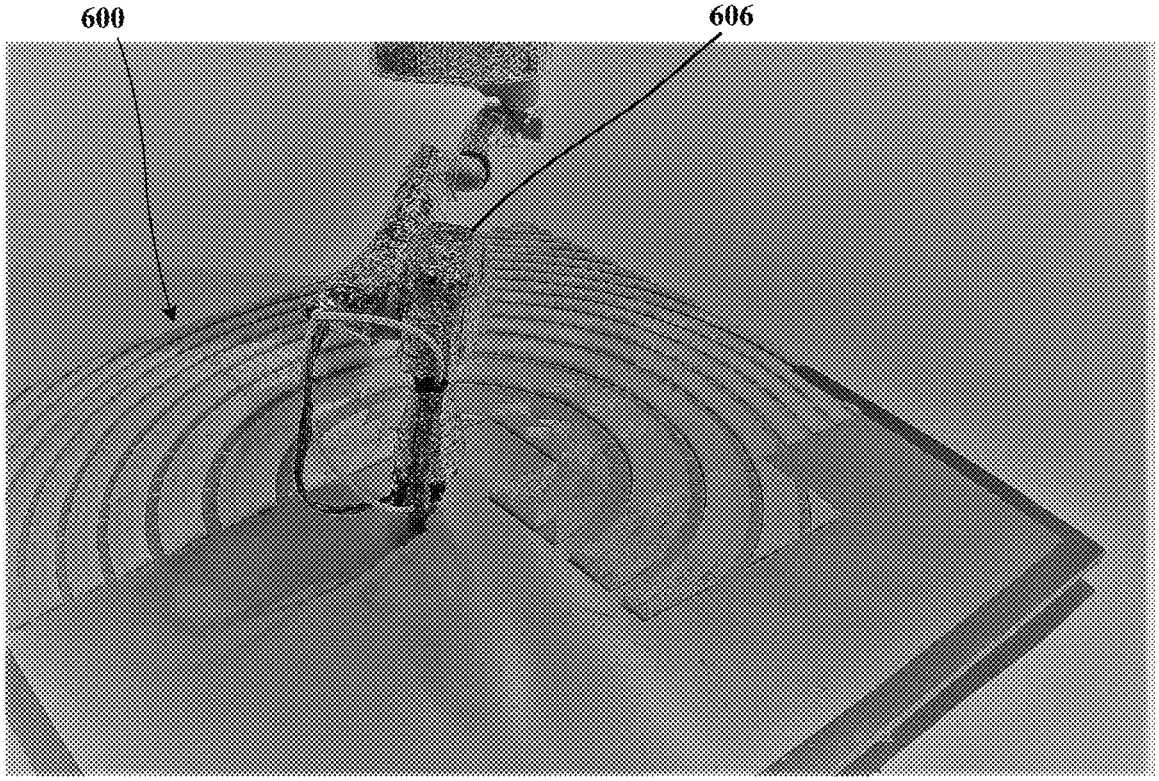

FIG. 6B illustrates an ISO view of a phased array lens/reflector 600. As depicted in the front view of FIG. 6A, examples of the phased array lens/reflector 600 include elliptical dielectric stepped rings with the individual 90 degree steps outlined (e.g., light region). In some examples, the phased array lens/reflector 600 includes a chiral lattice array 508 with spokes 512 and hubs 510. FIG. 6B depicts a robot arm 606 fabricating a phased array lens/reflector 600 onto a conductive ground plane.

In some examples, the lens is configured to modulate the wave front. In some instances, the lens differentially modifies the incident phase angle offsets. In such an instance, a plane wave is focused into a parabolic wave by selectively delaying or advancing portions of its wave front. In some configurations, the planar reflector is separated into nearly circular rings, where each ring is associated with about ¼ of the wave length of the carrier frequency. For example, rings 0, 4, 8, 12, 16, . . . etc. are associated with a phase offset of 0-90° and rings 1, 5, 9, 13, . . . etc. are associated with a phase offset 90-180° and so on. Each ring section adds a dielectric portion to the phased array lens/reflector 600 with a particular phase lag constant. For lenses of constant density, the focal point of our planar array includes repeating sets of stair-like features radiating out from the center of the reflector. In such an instance, stairs 0, 4, 8, 12, 16, . . . etc. are associated with 0° phase lag and stairs 1, 5, 9, 13, . . . etc. are associated with 90° phase lag and so on. Incident planar wave front phase angle modifications ensure that any incident photons to the reflector arrive at the observer lagging from 0° up to 90°. It should be appreciated that ring section resolution can be increased in order to decrease losses due to poor phase matching. It should be appreciated that ring section resolution can be decreased in order to increase losses due to poor phase matching.

Notably, light travels slower inside the thermoplastic (e.g., PEEK) than it does in a vacuum. As such, in some examples, changing the thickness, density, and additives of the dielectric lens, varies the time travelled from the source by each photon. As the time of flight changes, a spatial phase lag in the radio wave front results. The interference patterns on the wave front produced by the phase lags of each photon, constructively interfere at the focal point of an imaginary parabolic reflector dish. This brings the planar reflector to a focus.

In some examples, reflectors of different aperture radii and focal lengths can be fabricated onto the same mold, which facilitates the manufacturing of a wide variety of reflectors and lenses using a planar shape. It should be appreciated that a single factory can produce antenna systems for nano-satellites and massive geostationary communications satellites alike, thereby reducing costs. In some examples, a 3D printer using additive manufacturing can be included on the satellite. In some examples, the 3D printer is configured to manufacture antenna components described supra in space. In some configuration, the 3D printer includes a coaxial extruder. In such a configuration, large antennae and/or extremely large antennae can be manufactured in space.

Figure 7:
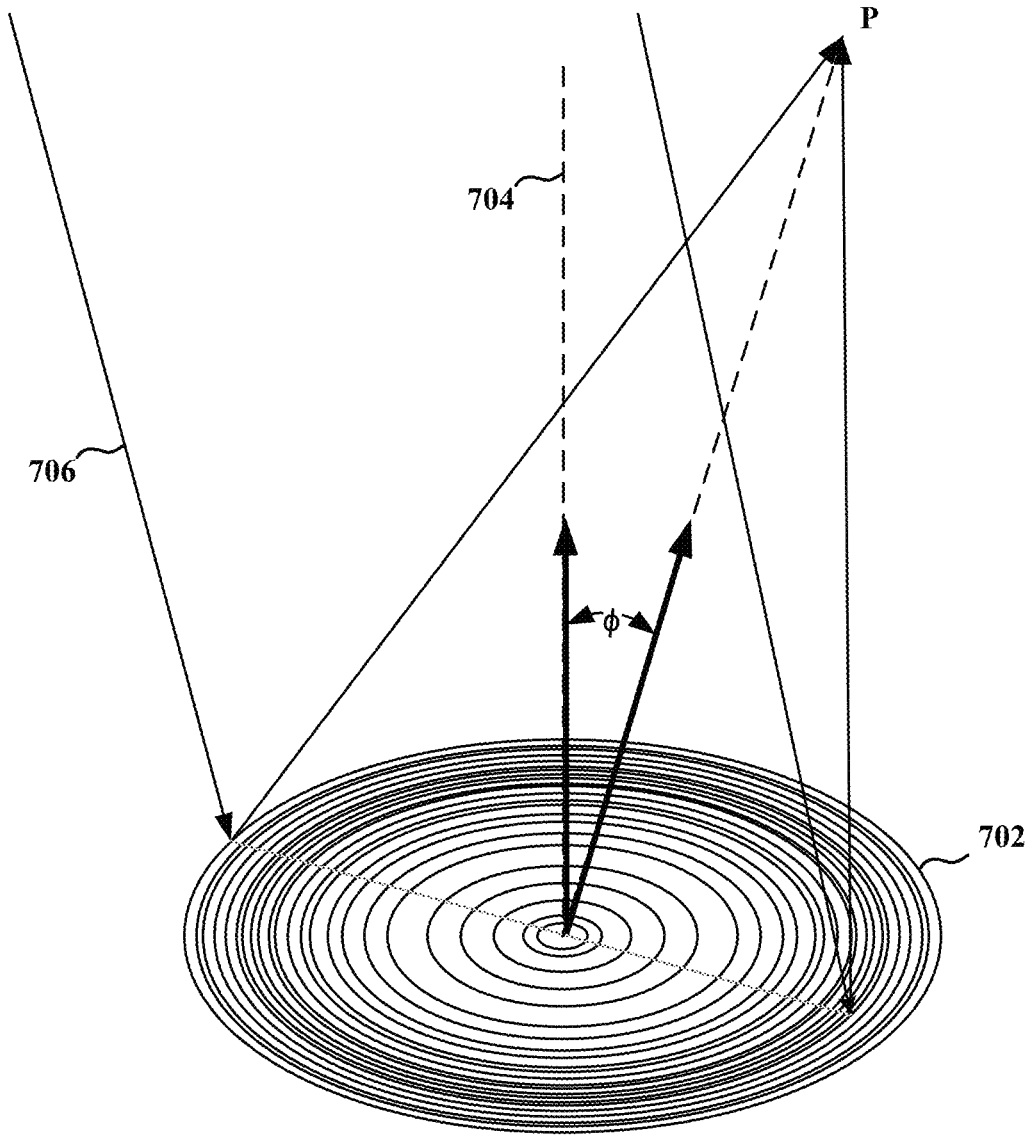
FIG. 7 illustrates a beam of electromagnetic energy reflecting off phased reflector.

FIG. 7 illustrates a beam of electromagnetic energy reflecting off a phased array reflector 702 at an offset angle $\phi$. As depicted in FIG. 7, the pattern of varying thicknesses includes a plurality of rings arrange as one or more one or more ellipses. Importantly, the one or more ellipses are offset so as to offset a focal point, P, from an optical axis 704 of the dielectric phased array reflector 702. This means, an incident beam 706 of electromagnetic energy will reflect off the phased array reflector 702 and be directed to the focal point P, as depicted. It should be appreciated the offset of the focal point, P, from the optical axis is a result the ellipses being of spaced closer together (e.g., non-concentric and compressed) on one side compared to the other. Notably, if the plurality of rings where concentric circles the focal point would be on the optical axis 704 rather than offset.

Figure 8A:
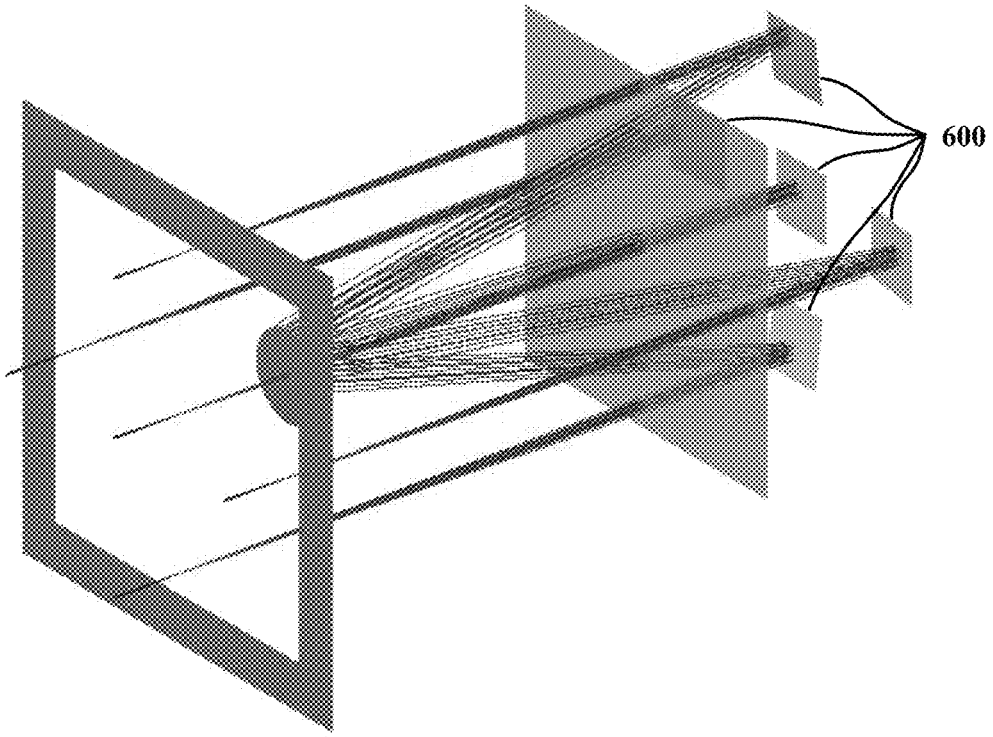
FIGS. 8A and 8B illustrate various phase arrayed reflectors.
Figure 8B:
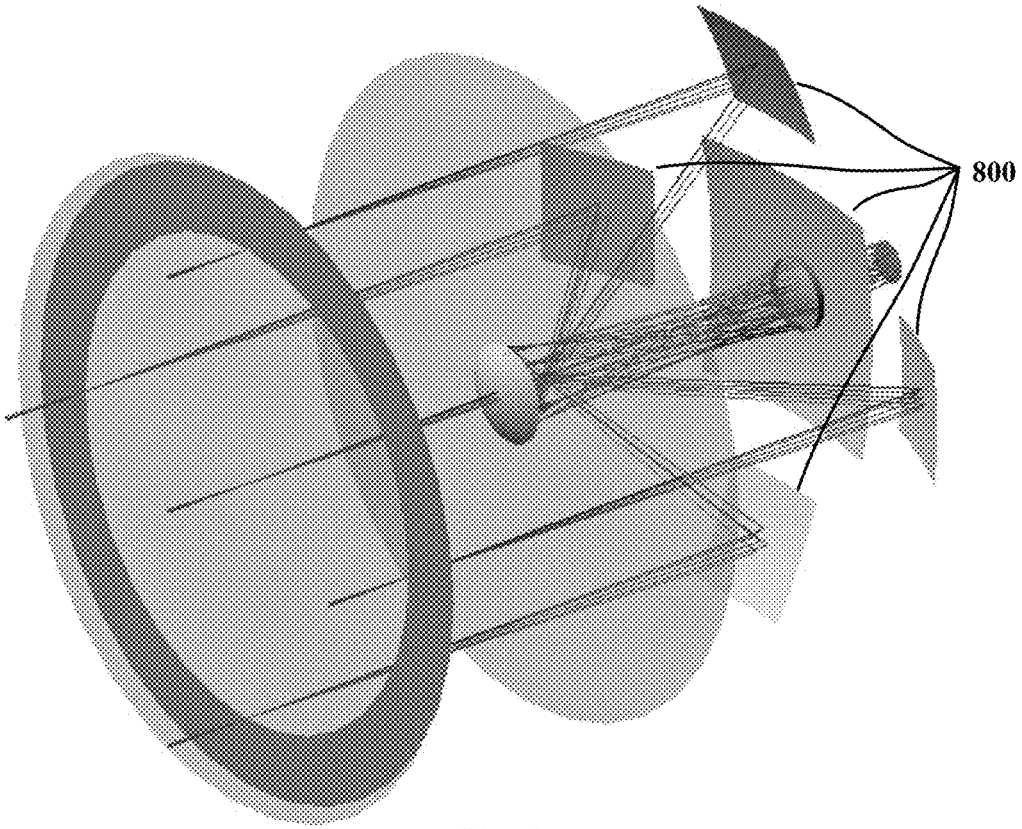

FIGS. 8A and 8B illustrate various arrayed reflectors. FIG. 8A depicts how various flat phased array lens/reflector 600 are arrayed similar to a large aperture reflective telescope. In this instance, each phased array lens/reflector 600 reference surface is substantially planar such that the reference surface is flat and separated from each other in order to increase resolution and decrease the aperture to launch mass ratio. In some configurations, the phased array lens/reflector 600 includes a ground plane covered in a continuous, low density mesh. The phased array lens/reflector 600 can be constructed from a set of interlocking springs.

FIG. 8B depicts various curved phased array lens/reflector 800 that are arrayed similar to a large aperture catadioptric telescope (e.g., Schmidt-Cassegrain). In this instance, each reflector has a reference surface is substantially non-planar such that the reference surface has a spherical curvature. In order to correct for the spherical curvature, the arrayed system of FIG. 8B includes a lens provided in the optical path. The lens can be made using additive manufacturing. In some examples, the curvature of the reference surface is parabolic. Similar to FIG. 8A, each reflector separated from each other in order to increase resolution and decrease the aperture to launch mass ratio. In some configurations, the curved phased array lens/reflector 800 includes a ground plane covered in a continuous, low density mesh. The curved phased array lens/reflector 800 can be constructed from a set of interlocking springs.

Figure 9:
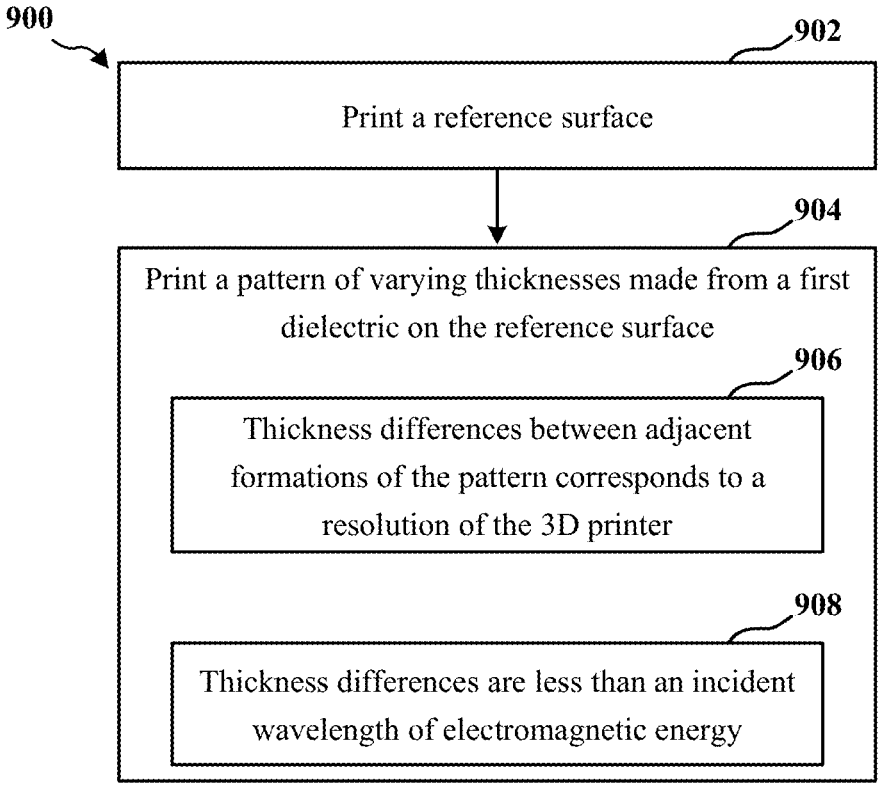
FIG. 9 is an exemplary flow diagram for manufacturing a phased array lens/reflector using additive manufacturing.

FIG. 9 is an exemplary flow diagram for manufacturing a phased array lens/reflector using additive manufacturing. Process 900 can be performed using a 3D printer or a robotic arm similar to the robotic arm 606 depicted in FIG. 6B.

At block 902, process 900 prints, using the 3D printer, a reference surface. In some examples, the reference surface is substantially planar such as the flat phased array lens/reflector 600 of FIG. 8A. In other examples, the reference surface is substantially non-planar curved such as the phased array lens/reflector 800 depicted in FIG. 8B. In some examples, the reference surface is made from the first dielectric. In some examples, the reference surface is an electrically conductive reflector.

At block 904, process 900 prints, using the 3D printer, a pattern of varying thicknesses made from a first dielectric on the reference surface. In such examples, the reference surface is made from a second dielectric different from the first dielectric of the pattern of varying thicknesses. In some examples, the reference surface is perforated. In some examples, the reference surface comprises a chiral Eigen mode lattice. The thickness differences between adjacent formations of the pattern of varying thicknesses corresponds to a resolution of the 3D printer, as depicted at block 906. In addition, The thickness differences are less than an incident wavelength of electromagnetic energy, as depicted at block 908. In some examples, the pattern of varying thicknesses includes a plurality of rings, as depicted in FIG. 6A. In such examples, the plurality of rings include one or more ellipses. In such examples, the one or more ellipses are offset so as to offset a focal point from an optical axis of the dielectric lens, as depicted in FIG. 7. In some examples, a combined thickness of the reference surface and the pattern of varying thickness is substantially uniform.

In other examples, the pattern of varying thicknesses includes a plurality of quantum dots. In such examples, the pattern of varying thicknesses includes a plurality of rings. In some examples, the pattern of varying thicknesses includes a plurality of quantum dots situated at nodes of a chiral Eigen mode lattice. In such examples, the chiral Eigen mode lattice maintains planar shape memory. In some examples, the individual chiral Eigen mode lattice cells are synclastic.

It is understood that the specific order or hierarchy of blocks in the processes and/or flowcharts disclosed is an illustration of exemplary approaches. Based upon design preferences, it is understood that the specific order or hierarchy of blocks in the processes and/or flowcharts may be rearranged. Further, some blocks may be combined or omitted. The accompanying method claims present elements of the various blocks in a sample order, and are not meant to be limited to the specific order or hierarchy presented.

The previous description is provided to enable any person skilled in the art to practice the various examples described herein. Various modifications to these examples will be readily apparent to those skilled in the art, and the generic principles defined herein may be applied to other examples. Thus, the claims are not intended to be limited to the examples shown herein, but are to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other examples. Unless specifically stated otherwise, the term "some" refers to one or more. Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various examples described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. The words "module," "mechanism," "element," "device," and the like may not be a substitute for the word "means." As such, no claim element is to be construed under 35 U.S.C § 112(f) unless the element is expressly recited using the phrase "means for."

What is claimed is:

1. A lens, comprising:

a first bladder, wherein the first bladder is configured to be filled with a first fluid, the first fluid having a first index of refraction; and a second bladder nested within the first bladder, wherein the second bladder is configured to be filled with a second fluid, the second fluid having a second index of refraction, and wherein at least a portion of the second bladder when filled with the second fluid, is spherically symmetric with the first bladder when filled with the first fluid.

2. The lens of claim 1, wherein at least a portion of the second bladder, when filled with the second fluid, has a spherical shape.

3. The lens of claim 1, wherein the second index of refraction is greater than the first index of refraction.

4. The lens of claim 1, wherein one or both of the first fluid and the second fluid is a liquid.

5. The lens of claim 1, wherein one or both of the first fluid and the second fluid is configured to solidify.

6. The lens of claim 1, further comprising:

a third bladder and nested within the second bladder, wherein the third bladder is configured to be filled with a third fluid, the third fluid having a third index of refraction.

7. The lens of claim 1, further comprising:

a first fluid injector hermetically connected to the first bladder and a first reservoir of the first fluid; and a second fluid injector hermetically connected to the second bladder and a second reservoir of the second fluid.

8. An antenna assembly, comprising:

a mounting fixture;

a lens, the lens further includes:

a first bladder connected to the mounting fixture, wherein the first bladder is configured to be filled with a first fluid, the first fluid having a first index of refraction;

a second bladder connected to the mounting fixture and nested within the first bladder, wherein the second bladder is configured to be filled with a second fluid, the second fluid having a second index of refraction, and wherein at least a portion of the second bladder when filled with the second fluid, is spherically symmetric with the first bladder when filled with the first fluid; and a first transmitter operatively coupled to the mounting fixture, wherein the first transmitter is configured to transmit a first electromagnetic signal through the lens.

9. The antenna assembly of claim 8, further comprising:

a second transmitter operatively coupled to the mounting fixture, wherein the second transmitter is configured to transmit a second electromagnetic signal through the lens, and wherein the second transmitter operates independent of the first transmitter.

10. The antenna assembly of claim 9, wherein one or both of the first transmitter and the second transmitter is configured to actuate around an outer surface of the first bladder.

11. The antenna assembly of claim 8, further comprising:

a first receiver operatively coupled to the mounting fixture, wherein the first receiver is configured to receive a third electromagnetic signal through the lens.

12. The antenna assembly of claim 11, further comprising:

a second receiver operatively coupled to the mounting fixture, wherein the second receiver is configured to receive a fourth electromagnetic signal through the lens, and wherein the second receiver operates independent of the first receiver.

13. The antenna assembly of claim 8, wherein the second index of refraction is greater than the first index of refraction.

14. The antenna assembly of claim 8, wherein one or both of the first fluid and the second fluid is a liquid configured to solidify.

15. The antenna assembly of claim 8, wherein the mounting fixture further includes:

a first fluid injector hermetically connected to the first bladder and a first reservoir of the first fluid; and a second fluid injector hermetically connected to the second bladder and a second reservoir of the second fluid.

16. A method for deploying an inflatable lens, the method comprising:

inflating a first bladder with a first fluid;

inflating a second bladder with a second fluid, wherein the second bladder is nested within the first bladder;

replacing the first fluid with a third fluid; and replacing the second fluid with a fourth fluid, wherein the second bladder, when filled with the third fluid, is spherically symmetric with the first bladder, when filled with the fourth fluid.

17. The method of claim 16, wherein the third fluid and the fourth fluid are the same fluid.

18. The method of claim 16, wherein an index of refraction of the fourth fluid is greater than an index of refraction of the third fluid.

19. The method of claim 16, wherein one or both of the third fluid and the fourth fluid is a liquid configured to solidify.

* * * * *